US009392359B2

(12) United States Patent
Akino

(10) Patent No.: US 9,392,359 B2
(45) Date of Patent: Jul. 12, 2016

(54) VARIABLE DIRECTIVITY ELECTRET CONDENSER MICROPHONE

(71) Applicant: KABUSHIKI KAISHA AUDIO-TECHNICA, Machida-shi, Tokyo (JP)

(72) Inventor: Hiroshi Akino, Machida (JP)

(73) Assignee: KABUSHIKI KAISHA AUDIO-TECHNICA, Machida-Shi, Tokyo (JP)

( * ) Notice: Subject to any disclaimer, the term of this patent is extended or adjusted under 35 U.S.C. 154(b) by 0 days.

(21) Appl. No.: 14/718,568

(22) Filed: May 21, 2015

(65) Prior Publication Data

US 2015/0341720 A1 Nov. 26, 2015

(30) Foreign Application Priority Data

May 23, 2014 (JP) ..... 2014-106838

(51) Int. Cl.

| | |
|---|---|
| ***H04R 1/32*** | (2006.01) |
| ***H04R 19/01*** | (2006.01) |
| ***H04R 1/40*** | (2006.01) |
| ***H04R 19/04*** | (2006.01) |
| ***H04R 1/04*** | (2006.01) |

(52) U.S. Cl.

CPC ..... *H04R 1/326* (2013.01); *H04R 1/04* (2013.01); *H04R 1/40* (2013.01); *H04R 19/016* (2013.01); *H04R 19/04* (2013.01)

(58) Field of Classification Search

None

See application file for complete search history.

(56) References Cited

U.S. PATENT DOCUMENTS

| | | | | |
|---|---|---|---|---|
| 3,870,820 A * | 3/1975 | Suzuki | H04R 1/38 | 381/358 |
| 2005/0031150 A1* | 2/2005 | Collins | H04R 1/38 | 381/355 |
| 2008/0152174 A1* | 6/2008 | Marshall | H04R 19/04 | 381/172 |

FOREIGN PATENT DOCUMENTS

| | | |
|---|---|---|
| JP | 2008-118260 A | 5/2008 |
| JP | 2012-065147 A | 3/2012 |

* cited by examiner

*Primary Examiner* — Paul Huber

(74) *Attorney, Agent, or Firm* — Manabu Kanesaka

(57) ABSTRACT

Provided is a variable directivity electret condenser microphone that can simplify a circuit configuration, and outputs an audio signal in a balanced manner, which includes electrically independent first and second electret condenser microphone units in which first and second fixed electrodes are arranged back to back and facing each other in a mutually non-conductive state, and first and second diaphragms are arranged facing the first and second fixed electrodes with fixed intervals therefrom respectively, a first impedance converter having an input terminal connected to the first fixed electrode, and a first buffer circuit connected to the first impedance converter, a second impedance converter having an input terminal connected to the second fixed electrode, and a second buffer circuit selectively connected to the second impedance converter, and a directivity variable switch that can alternatively select a mode from at least a first directivity mode to a third directivity mode.

14 Claims, 6 Drawing Sheets

VARIABLE DIRECTIVITY ELECTRET CONDENSER MICROPHONE

RELATED APPLICATIONS

The present application is based on, and claims priority from, Japanese Application No. JP2014-106838 filed May 23, 2014, the disclosure of which is hereby incorporated by reference herein in its entirety.

BACKGROUND OF THE INVENTION

1. Field of the Invention

The present invention relates to a condenser microphone including a variable directivity function by including two microphone units back to back, and especially relates to a variable directivity electret condenser microphone that uses electrets for the condenser microphone units, and outputs an audio signal in a balanced manner.

2. Description of the Related Art

As a microphone that can vary directivity, one in which microphone units having a cardioid characteristic are arranged in front and back in a back to back manner has been proposed.

Typically, condenser microphones are suitable for collection of wideband sounds compared with dynamic microphones, and are superior in directional frequency response.

One that realizes the variable directivity by adding/subtracting a polarization voltage to be added to the respective condenser microphone units by taking advantage of characteristics of the condenser microphones is disclosed in "Condenser microphone with variable polar response", Microphone Engineering Handbook (p. 32, FIG. 1.18) written by Michael Gayford (Non-Patent Document 1).

Meanwhile, the applicant of the present application has an earlier filed patent application about a variable directivity condenser microphone that has overcome technical problems in the condenser microphone disclosed in Non-Patent Document 1, and this patent application is disclosed in JP 2012-65147 A.

According to the condenser microphone disclosed in JP 2012-65147 A, a decrease in output sensitivity and deterioration of S/N caused due to alternating current coupling of the front and back diaphragms like the condenser microphone disclosed in Non-Patent Document 1 can be prevented.

In the cases of using the two condenser microphone units that require the polarization voltage disclosed in Non-Patent Document 1 and JP 2012-65147 A, it is necessary to include a configuration that the polarization voltage of 60 V or more is obtained by a DC-DC converter or the like using a direct-current power source of about 5 to 20 V, which operates a circuit of an impedance converter or the like.

According to the above configuration, it is also necessary to include an auxiliary configuration of the above-described DC-DC converter and the like in the condenser microphone units, and thus it is inevitable to have an increase in the cost.

Therefore, the applicant of the present application also has a patent application about a variable directivity condenser microphone using an electret dielectric film in the two condenser microphone units, and this application is disclosed in JP 2008-118260 A. According to the variable directivity condenser microphone disclosed in JP 2008-118260 A, outputs of the two condenser microphone units are coupled with a variable-capacity capacitor (variable capacitor), whereby a microphone that can continuously change the directivity can be realized.

By the way, JP 2012-65147 A also discloses an example of a variable directivity condenser microphone using an electret condenser microphone unit that does not need the polarization voltage. According to an example using the electret condenser microphone unit disclosed in JP 2012-65147 A, phase adjustment means is employed, which includes a phase inverting amplifier in which a phase of input/output is inverted with a gain of "1", and selects outputs of the phase inverting amplifier and a non-inverting amplifier in which the phase of input/output is not inverted with the gain of "1". Therefore, employment of the phase adjustment means has a problem of complexity of a circuit configuration, and thus there is room for improvement.

Further, according to the variable directivity condenser microphone disclosed in JP 2008-118260 A, the configuration of coupling the outputs of the two electret condenser microphone units with the variable-capacity capacitor (variable capacitor) is employed. Therefore, an electrostatic capacity is changed when external vibration is added to the variable-capacity capacitor, and this becomes a cause of occurrence of noise.

Therefore, a measure against the external vibration that affects the variable-capacity capacitor is required, and there is room for improvement on this point.

Meanwhile, in this sort of microphones, when a considerable length of microphone cord is required in a case where the microphones are used in a hall, an event site, or the like, or when the microphones are used for professional use such as to authentically collect sounds of music with a high S/N in a studio or the like, a balanced shield cable is used as the microphone cord.

Therefore, a balanced output system is employed for a sound output of the microphones used in the above cases, audio signals from the microphones are sent to a mixer and the like through the balanced shield cable. Then, the mixer side extracts the audio signals using a differential amplifier or a microphone transformer, thereby to obtain audio signals with reduced common mode noise.

SUMMARY OF THE INVENTION

An objective of the present invention is to provide a variable directivity electret condenser microphone that overcomes the above-described problems of the electret condenser microphone that varies directivity by arranging two microphone units in front and back in a back to back manner, and which outputs an audio signal in a balanced manner.

A favorable embodiment (a first embodiment) of a variable directivity electret condenser microphone according to the present invention made to solve the above-described problems includes: electrically independent first and second electret condenser microphone units in which first and second fixed electrodes are arranged back to back and facing each other in a mutually non-conductive state, and first and second diaphragms are arranged facing the first and second fixed electrodes with fixed intervals from the first and second fixed electrodes, respectively; a first impedance converter having an input terminal connected to the first fixed electrode, and a first buffer circuit connected to the first impedance converter; a second impedance converter having an input terminal connected to the second fixed electrode, and a second buffer circuit selectively connected to the second impedance converter; and a directivity variable switch that is able to alternatively select a mode from at least a first directivity mode to a third directivity mode, wherein, when the directivity variable switch selects the first directivity mode, the second buffer circuit is connected to an output terminal of the second impedance converter, when the directivity variable switch selects the second directivity mode, an input terminal of the second buffer circuit is grounded, when the directivity variable switch selects the third directivity mode, the first diaphragm is connected to the output terminal of the second impedance converter, and the input terminal of the second buffer circuit is grounded, and the second diaphragm is grounded at all times, and balanced outputs of audio signals are derived from output terminals of the first and second buffer circuits.

Further, another favorable embodiment (a second embodiment) of a variable directivity electret condenser microphone according to the present invention made to solve the above-described problems includes: electrically independent first and second electret condenser microphone units in which first and second fixed electrodes are arranged back to back and facing each other in a mutually non-conductive state, and first and second diaphragms are arranged facing the first and second fixed electrodes with fixed intervals from the first and second fixed electrodes, respectively; a first impedance converter having an input terminal connected to the first diaphragm, and a first buffer circuit connected to the first impedance converter; a second impedance converter having an input terminal connected to the second diaphragm, and a second buffer circuit selectively connected to the second impedance converter, and a directivity variable switch that is able to alternatively select a mode from at least a first directivity mode to a third directivity mode, wherein, when the directivity variable switch selects the first directivity mode, the second buffer circuit is connected to an output terminal of the second impedance converter, when the directivity variable switch selects the second directivity mode, an input terminal of the second buffer circuit is grounded, when the directivity variable switch selects the third directivity mode, the first fixed electrode is connected to the output terminal of the second impedance converter, and the input terminal of the second buffer circuit is grounded, and the second fixed electrode is grounded at all times, and balanced outputs of audio signals are derived from output terminals of the first and second buffer circuits.

In either embodiment, as the directivity variable switch, a two-interlocking type three-point selector switch can be favorably used.

Further, a configuration to mix the balanced output audio signals respectively derived from the output terminals of the first and second buffer circuits, with a mixer, and to output a mixed audio signal is employed.

Further, a configuration to supply a phantom power source for the variable directivity electret condenser microphone from the output terminals of the first and second buffer circuits can also be favorably employed.

Further, in the first embodiment of the variable directivity electret condenser microphone, the first electret condenser microphone unit is a front-side unit at a sound collection axis and the second electret condenser microphone unit is a back-side unit at the sound collection axis.

Still further, in the second embodiment of the variable directivity electret condenser microphone, the first electret condenser microphone unit is a back-side unit at the sound collection axis and the second electret condenser microphone unit is a front-side unit at the sound collection axis.

In either embodiment of the variable directivity electret condenser microphone, when the directivity variable switch selects the first directivity mode, the mode is set to unidirectivity, when the directivity variable switch selects the second directivity mode, the mode is set to bidirectivity, and when the directivity variable switch selects the third directivity mode, the mode is set to omnidirectivity.

Further, in either embodiment of the variable directivity electret condenser microphone, a direct-current operation voltage is supplied to the first and second impedance converter from a common constant voltage circuit.

The variable directivity electret condenser microphone according to the present invention includes the first and second impedance converters, the first and second buffer circuits, and the selector switch as the directivity variable switch, in addition to the first and second electret condenser microphone units. Accordingly, the variable directivity electret condenser microphone that realizes a balanced output of audio signals can be provided.

Therefore, the variable directivity electret condenser microphone according to the present invention does not need a special circuit configuration such as a phase inverting amplifier, and can simplify the circuit configuration, compared with the example disclosed in JP 2012-65147 A described above.

Further, the variable directivity electret condenser microphone according to the present invention can overcome the problem of occurrence of noise due to vibration caused by employment of a variable-capacity capacitor (variable capacitor), and can contribute to the simplification of the circuit configuration, compared with the example disclosed in JP 2008-118260 A described above.

DESCRIPTION OF THE PREFERRED EMBODIMENTS

Figure 1:
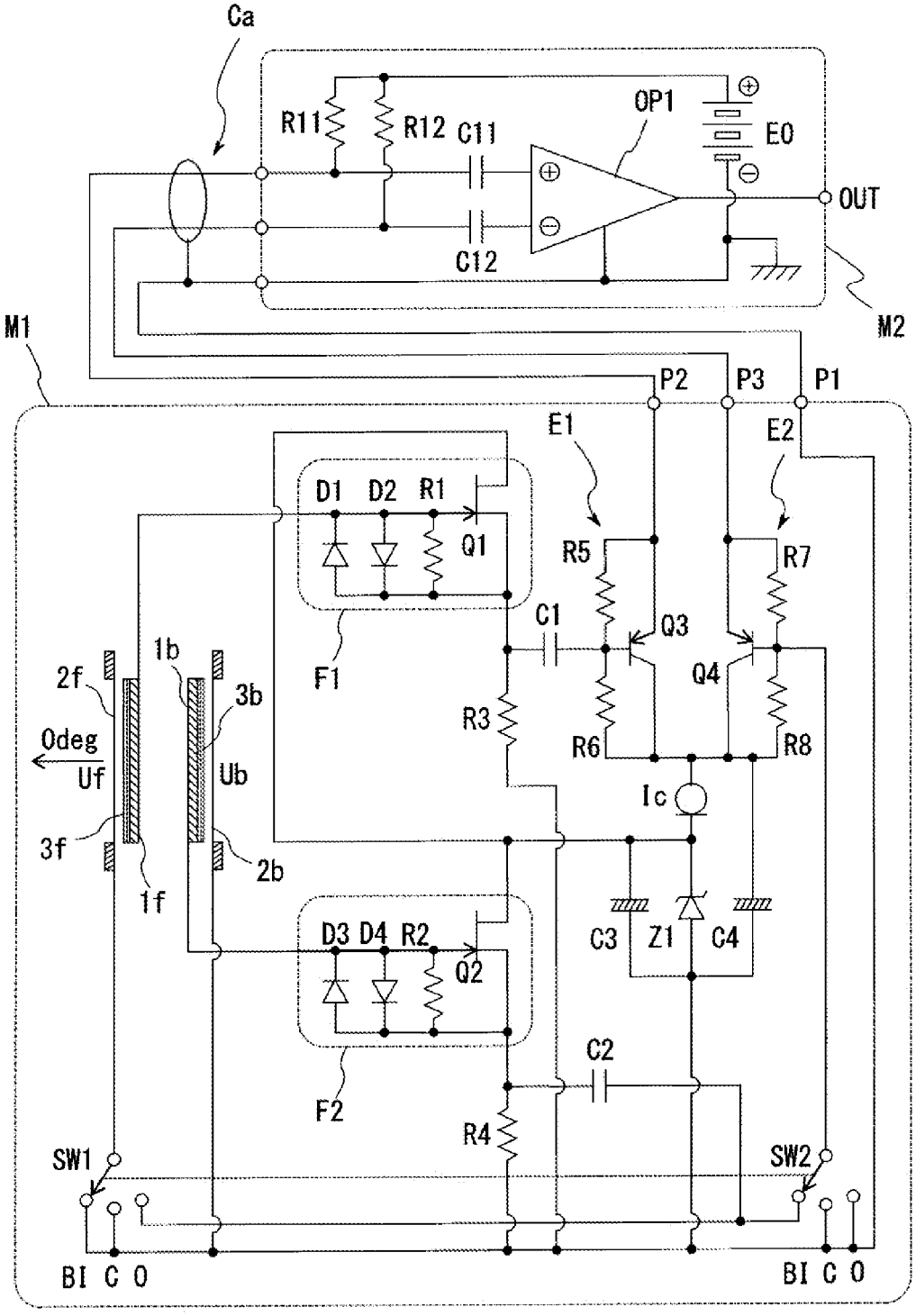
FIG. 1 is a circuit connection diagram illustrating a first embodiment of a variable directivity electret condenser microphone according to the present invention.

A variable directivity electret condenser microphone according to the present invention will be described based on embodiments illustrated in the drawings.

FIG. 1 illustrates a state in which a mixer M2 is connected to a variable directivity electret condenser microphone M1 according to the present invention through a balanced shield cable Ca, and the variable directivity electret condenser microphone M1 is configured to receive a drive current from a phantom power source device at the side of the mixer M2.

First, the variable directivity electret condenser microphone illustrated by the reference sign M1 is configured from two electrically independent electret condenser microphone units in front and back.

Note that, between these two electret condenser microphone units, one at a sound collection axis side illustrated by the arrow 0 deg is referred to as front-side unit Uf, and the other one at an opposite side is referred to as back-side unit Ub.

First and second fixed electrodes 1*f* and 1*b* that configure the front-side unit Uf and the back-side unit Ub are arranged back to back in a mutually non-conductive state, and first and second diaphragms 2*f*, 2*b* are arranged facing the first and second fixed electrodes 1*f* and 1*b* with fixed intervals from the first and second fixed electrodes 1*f* and 1*b*, respectively.

In the present embodiment, electret dielectric films 3*f* and 3*b* are respectively provided on surfaces of the first and second fixed electrodes 1*f* and 1*b*, the surfaces facing the diaphragms 2*f* and 2*b*, and respectively configure back-electret condenser microphone units.

F1 and F2 illustrated in FIG. 1 are first and second impedance converters, and these first and second impedance converters are formed of the same circuit configuration. That is, bias circuit built-in type FETs Q1 and Q2 are respectively included in the first and second impedance converters F1 and F2.

Diodes D1 and D2, and a resistance R1 are connected in reverse parallel between a gate and a source of the FET Q1, and serve as a function to generate a gate bias of the FET Q1. Further, similarly, diodes D3 and D4, and a resistance R2 are connected in reverse parallel between a gate and a source of the FET Q2, and serve as a function to generate a gate bias of the FET Q2.

Then, a direct-current operation voltage is supplied from a constant voltage circuit described below to each of drains of the FETs Q1 and Q2, and source resistances R3 and R4 are respectively connected to the respective sources of the FETs Q1 and Q2 to configure source follower circuits.

Further, capacitors C1 and C2 are respectively connected to the first and second impedance converters F1 and F2 that configure the source follower circuits, and signals by the front-side unit Uf and the back-side unit Ub, which have been subjected to impedance conversion, are respectively drawn through the capacitors C1 and C2.

The signal by the first impedance converter F1 through the capacitor C1 is supplied to an emitter follower circuit E1 as a first buffer circuit including a transistor Q3. Further, the signal by the second impedance converter F2 through the capacitor C2 is supplied to an emitter follower circuit E2 as a second buffer circuit selectively including a transistor Q4, through directivity variable switches described below.

The first emitter follower circuit E1 includes bias setting resistances R5 and R6, and configures the mixer M2 side through a terminal pin P2, as a load resistance (emitter resistance). An output of the emitter follower is supplied to the terminal pin P2, as a hot-side output.

Similarly, the second emitter follower circuit E2 includes bias setting resistances R7 and R8, and configures the mixer M2 side through a terminal pin P3, as a load resistance (emitter resistance). An output of the emitter follower is supplied to the terminal pin P3, as a cold-side output.

Then, signal outputs by the first buffer circuit E1 and the second buffer circuit E2 are output to the mixer M2 in a balanced manner through the balanced shield cable Ca having a terminal pin P1, as a ground line.

Meanwhile, a phantom power source is supplied from the mixer M2 side to the terminal pins P2 and P3, having the terminal pin P1, as the ground line.

Then, collectors of the transistors Q3 and Q4 are commonly connected to a constant current element Ic, and the constant voltage circuit by a constant voltage element Z1 and an electrolyte capacitor C3 is formed between the constant current element Ic and the ground line of the terminal pin P1.

Therefore, the constant voltage by the phantom power source generated by the constant voltage circuit is supplied to the drains of the EFTs Q1 and Q2 that configure the first and second impedance converters F1 and F2.

Note that, in the present embodiment, an electrolyte capacitor C4 for an alternating-current coupling bypass is connected to bridge the series circuit of the constant current element Ic and the constant voltage element Z1.

Reference signs SW1 and SW2 illustrated in FIG. 1 are two-interlocking type three-point selector switches, and the switches SW1 and SW2 function as directivity variable switches that alternatively select a mode from first to third directivity modes.

Then, when the switches SW1 and SW2 select the positions indicated by the reference signs BI, the mode is set to bidirectivity (bidirectional characteristics). When the switches SW1 and SW2 select the positions indicated by the reference signs C, the mode is set to unidirectivity (cardioid characteristics). Further, when the switches SW1 and SW2 select the positions indicated by the reference signs O, the mode is set to omnidirectivity (omnidirectional characteristics).

The directivity selecting functions based on these selections will be described below based on FIGS. 2 to 4.

A first diaphragm 2*f* that configures the front-side unit Uf is connected to a movable contact of the first switch SW1 that functions as the directivity variable switch. Further, a movable contact of the second switch SW2 is connected to a base of the transistor Q4 that configures the second emitter follower circuit E2.

Further, fixed contacts BI and C of the first switch SW1 are connected to the ground line of the terminal pin P1, and fixed contacts C and O of the second switch SW2 are also connected to the ground line of the terminal pin P1. Further, a fixed contact O of the first switch SW1 and a fixed contact BI of the second switch SW2 are commonly connected, and the capacitor C2 from the second impedance converter F2 is connected to the common contact point.

That is, it is configured such that a signal from the back-side unit Ub is added to the connection point between the fixed contact O of the first switch SW1 and the fixed contact BI of the second switch SW2.

As described above, the variable directivity electret condenser microphone M1 is connected to the mixer M2 side with the balanced shield cable Ca through the terminal pins P1 to P3.

A subtraction circuit OP1 by an operational amplifier is mounted on the mixer M2. A signal from the terminal pin P2 is supplied to a non-inverting input terminal of the subtraction circuit OP1 through a capacitor C11, and a signal from the terminal pin P3 is supplied to an inverting input terminal of the subtraction circuit OP1 through a capacitor C12. With the configuration, balanced output audio signals from the terminal pins P2 and P3 are mixed by the mixer M2, and a subtraction output by the subtraction circuit OP1 is brought to an output terminal OUT, as an audio signal by the microphone M1.

Note that a direct-current power source E0 of 48 V, which functions as the phantom power source, is included at the mixer M2 side, and the direct-current power source E0 is sent to the terminal pins P2 and P3 through resistances R11 and R12 of 6.8 KO, respectively.

Figure 2:
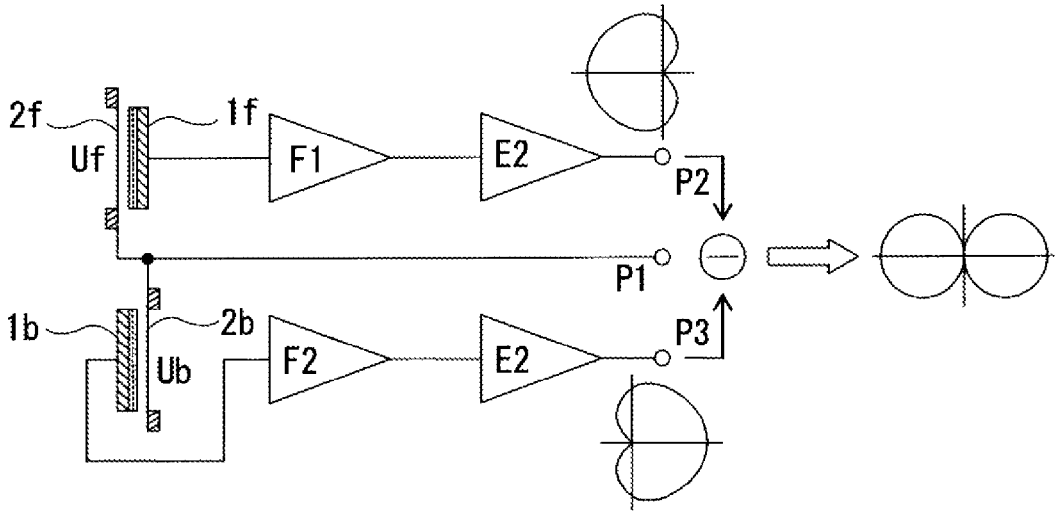
FIG. 2 is an equivalent circuit diagram of when a first directivity mode is selected in the configuration illustrated in FIG. 1.
Figure 3:
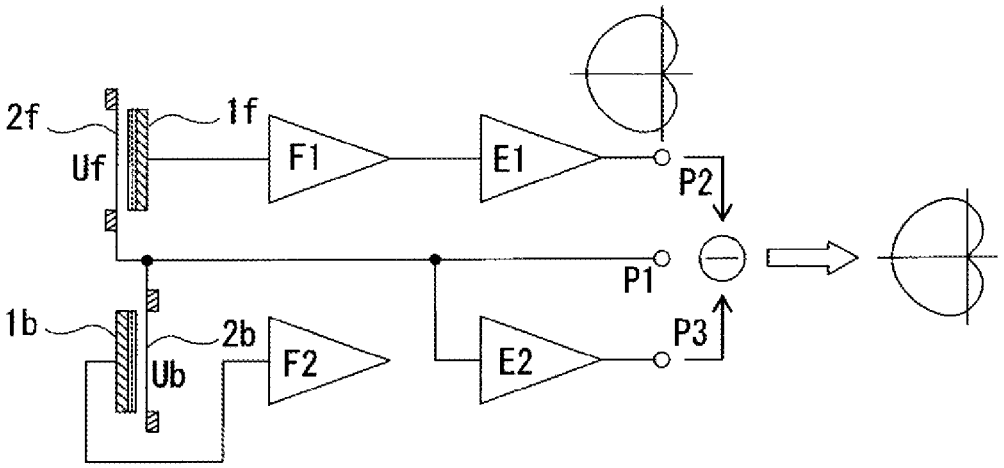
FIG. 3 is an equivalent circuit diagram of when a second directivity mode is similarly selected.
Figure 4:
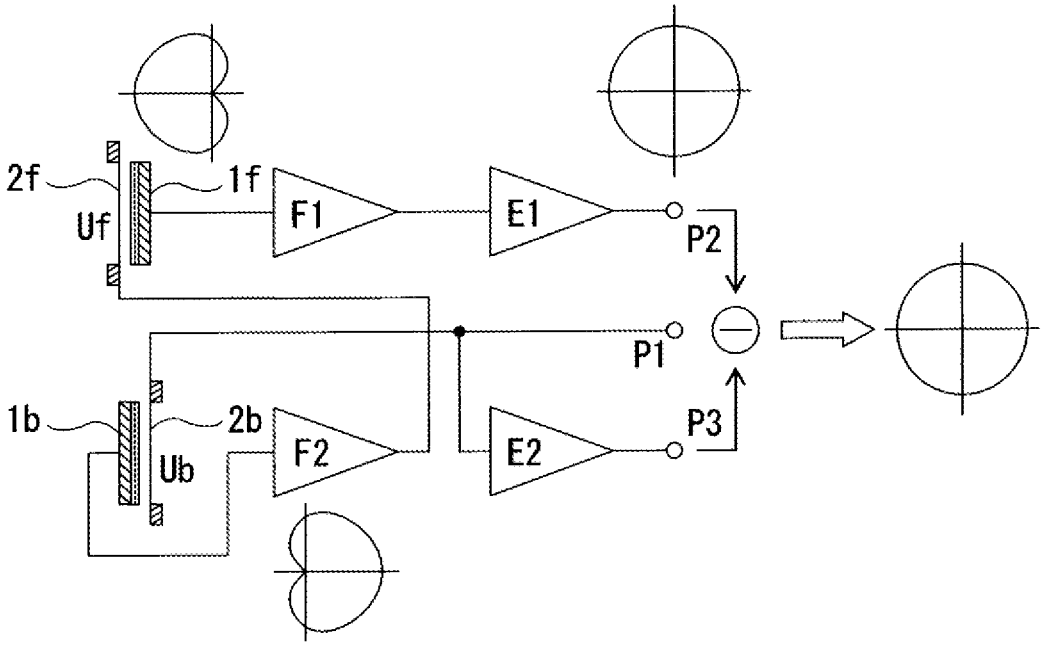
FIG. 4 is an equivalent circuit diagram of when a third directivity mode is similarly selected.

FIGS. 2 to 4 illustrate equivalent circuit diagrams of when the first and second switches SW1 and SW2 as directivity variable switches are selected to the bidirectivity BI, the unidirectivity C, and the omnidirectivity O, respectively, in the above-described configuration of the variable directivity electret condenser microphone M1 illustrated in FIG. 1. Further, FIGS. 2 to 4 illustrate states of addition/subtraction calculation of polar patterns obtained by the front-side unit Uf and the back-side unit Ub, in addition to the equivalent circuit diagrams.

That is, when the directivity variable switches select BI that is a first directivity mode, an input terminal of the second buffer circuit E2 is connected to an output terminal of the second impedance converter F2, as illustrated in FIG. 2.

Accordingly, signals of the polar patterns illustrated in FIG. 2 are respectively supplied to the second terminal pin P2 and the third terminal pin P3, and are subtracted in the subtraction circuit OP1 of the mixer M2. As a result, an audio signal having the bidirectivity can be obtained.

Next, when the directivity variable switches select the unidirectivity C that is a second directivity mode, the input terminal of the second buffer circuit E2 is grounded, as illustrated in FIG. 3.

Accordingly, while a signal of the polar pattern illustrated in the drawing is supplied to the second terminal pin P2, the third terminal pin P3 becomes no signal. As a result, as the subtraction output of the subtraction circuit OP1 of the mixer M2, an audio signal having the unidirectivity is provided.

Further, when the directivity variable switches select the omnidirectivity O that is a third directivity mode, the first diaphragm 2*f* is connected to the output terminal of the second impedance converter F2, and the input terminal of the second buffer circuit E2 is grounded, as illustrated in FIG. 4.

Accordingly, the signal by the back-side unit Ub from the second impedance converter F2 is added to the first diaphragm 2*f* of the front-side unit Uf, and the polar pattern by the back-side unit Ub and the polar pattern by the front-side unit Uf are added, and a signal having the polar pattern of the omnidirectivity is supplied to the second terminal pin P2 as illustrated in the drawings.

Meanwhile, the input terminal of the second buffer circuit E2 is grounded, and thus the third terminal pin P3 becomes no signal. As a result, as a subtraction output by the subtraction circuit OP1 of the mixer M2, the audio signal of the omnidirectivity illustrated in FIG. 4 is provided.

Figure 5:
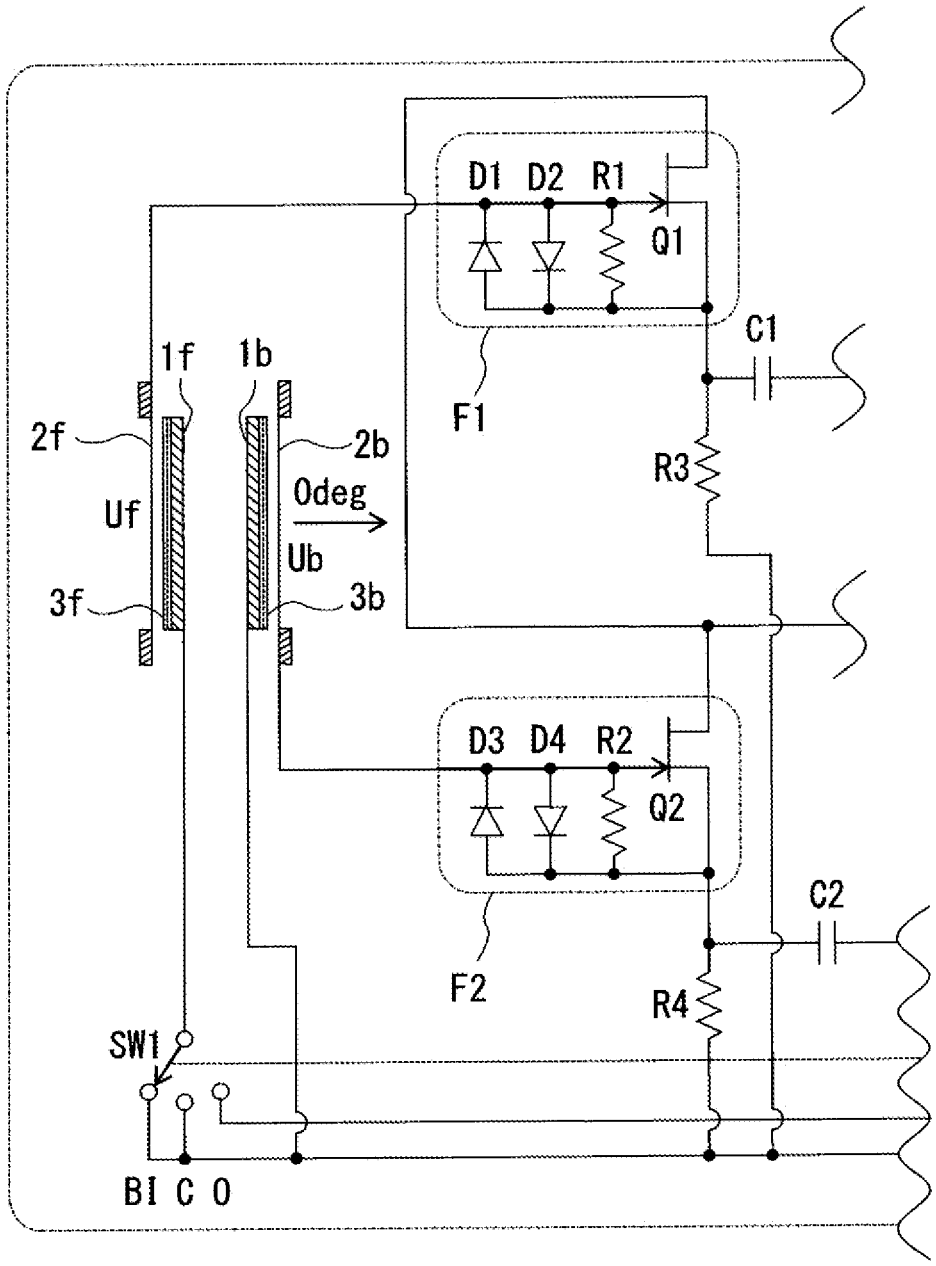
FIG. 5 is a circuit connection diagram illustrating a principal part of a second embodiment of a variable directivity electret condenser microphone according to the present invention.

FIG. 5 illustrates a second embodiment of a variable directivity electret condenser microphone according to the present invention, and FIG. 5 illustrates principal parts only, which are alternative to the variable directivity electret condenser microphone M1 described based on FIG. 1.

In the example illustrated in FIG. 5, a first fixed electrode 1*f* and a first diaphragm 2*f* in a front-side unit Uf are mutually switched and connected, and a second fixed electrode 1*b* and a second diaphragm 2*b* in a back-side unit Ub are also mutually switched and connected, with respect to the example illustrated in FIG. 1.

That is, the first diaphragm 2*f* that configures the front-side unit Uf is connected to an input terminal of a first impedance converter F1, and the first fixed electrode 1*f* is connected to a movable contact of a first switch SW1. Further, the second diaphragm 2*b* that configures the back-side unit Ub is connected to an input terminal of a second impedance converter F2, and the second fixed electrode 1*b* is connected to a ground line by a terminal pin P1. Other configurations are the same as the configurations illustrated in FIG. 1.

According to the configuration illustrated in FIG. 5, the variable directivity electret condenser microphone is different from the variable directivity electret condenser microphone illustrated in FIG. 1 in that a sound collection axis illustrated by the arrow 0 deg comes to a front surface side of the back-side unit Ub.

Figure 6:
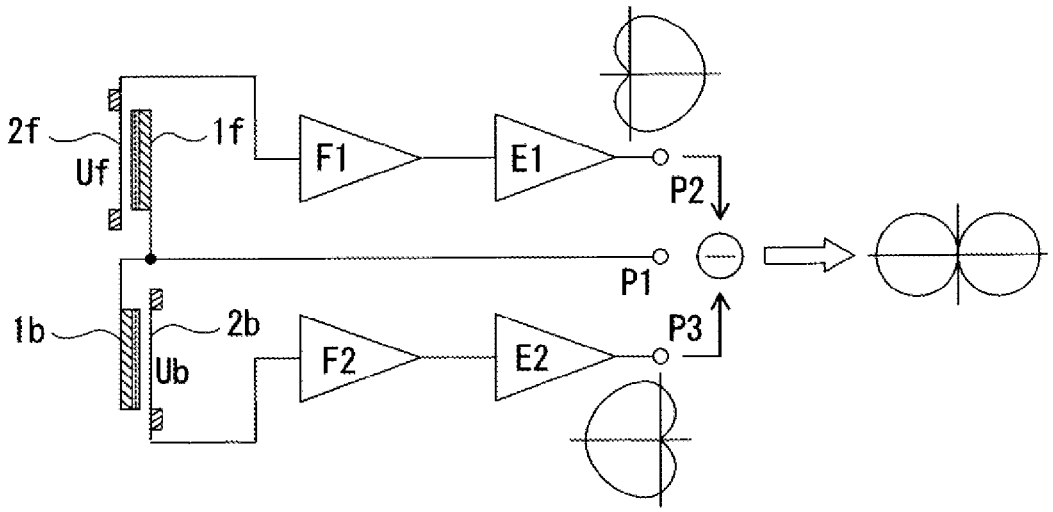
FIG. 6 is an equivalent circuit diagram of when a first directivity mode is selected in the configuration illustrated in FIG. 5.
Figure 7:
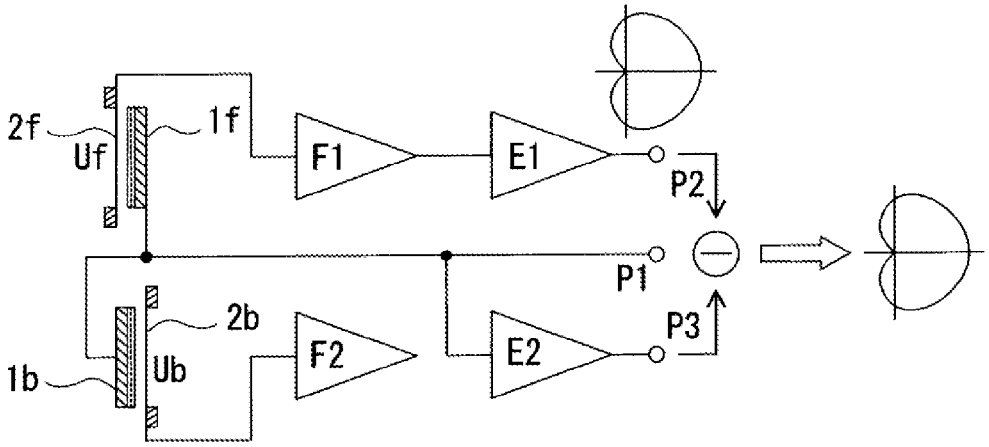
FIG. 7 is an equivalent circuit diagram of when a second directivity mode is similarly selected.
Figure 8:
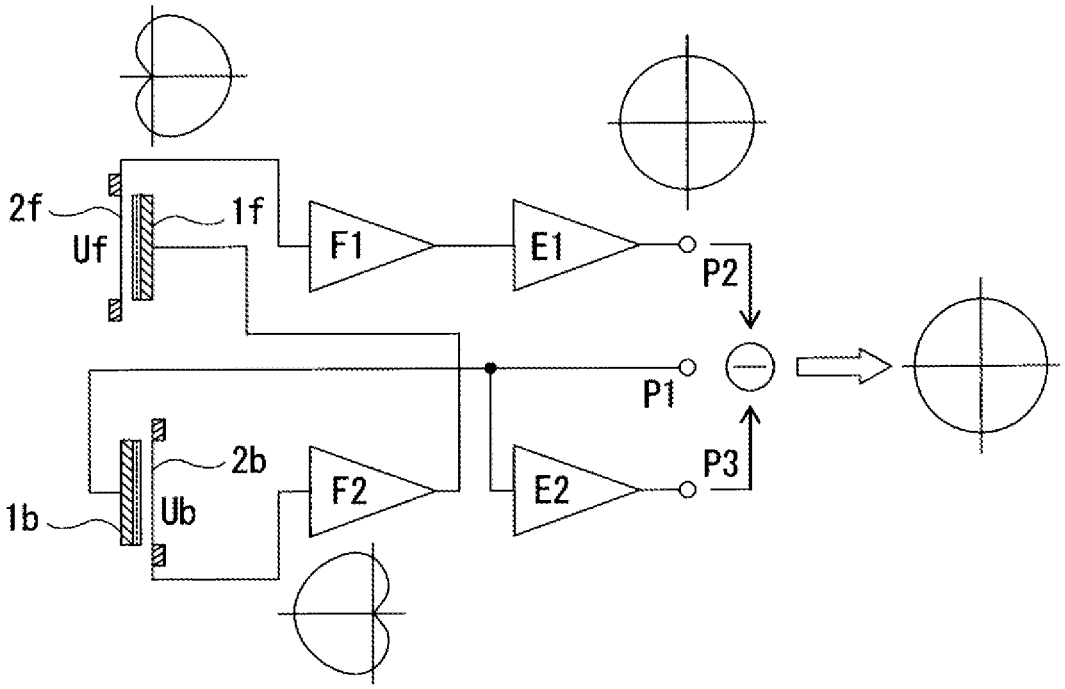
FIG. 8 is an equivalent circuit diagram of when a third directivity mode is similarly selected.

FIGS. 6 to 8 illustrates equivalent circuit diagrams of when first and second switches SW1 and SW2 as directivity variable switches in the second embodiment illustrated in FIG. 5 are set to bidirectivity BI, unidirectivity C, and omnidirectivity O, respectively. Further, FIGS. 6 to 8 illustrate states of addition/subtraction calculation of polar patterns obtained by the front-side unit Uf and the back-side unit Ub, in addition to the equivalent circuit diagrams.

That is, FIGS. 6 to 8 correspond to the equivalent circuit diagrams in the first embodiment illustrated in FIGS. 2 to 4, described above.

In the second embodiment illustrated in FIG. 5, when the directivity variable switches select BI that is a first directivity mode, an input terminal of a second buffer circuit E2 is connected to an output terminal of the second impedance converter F2, as illustrated in FIG. 6.

Accordingly, signals of the polar patterns illustrated in FIG. 6 are respectively supplied to a second terminal pin P2 and a third terminal pin P3, and are subtracted in a subtraction circuit OP1 of the mixer M2. As a result, an audio signal having the bidirectivity can be obtained.

Next, when the directivity variable switches select the unidirectivity C that is a second directivity mode, the input terminal of the second buffer circuit E2 is grounded, as illustrated in FIG. 7.

Accordingly, while a signal of the polar pattern illustrated in the drawing is supplied to the second terminal pin P2, the third terminal pin P3 becomes no signal. As a result, as a subtraction output by the subtraction circuit OP1 of the mixer M2, an audio signal having the unidirectivity is provided.

Further, when the directivity variable switches select the omnidirectivity O that is a third directivity mode, the first fixed electrode 1*f* is connected to the output terminal of the second impedance converter F2, and the input terminal of the second buffer circuit E2 is grounded, as illustrated in FIG. 8.

Accordingly, the signal by the back-side unit Ub from the second impedance converter F2 is added to the first fixed electrode 1*f* of the front-side unit Uf, and the polar pattern by the back-side unit Ub and the polar pattern by the front-side unit Uf are added, and a signal having the polar pattern of the omnidirectivity is supplied to the second terminal pin P2, as illustrated in the drawing.

Meanwhile, the input terminal of the second buffer circuit E2 is grounded, and thus the third terminal pin P3 becomes no signal. As a result, as a subtraction output by the subtraction circuit OP1 of the mixer M2, an audio signal of the omnidirectivity illustrated in FIG. 8 is provided.

What is claimed is:

1. A variable directivity electret condenser microphone comprising:

electrically independent first and second electret condenser microphone units in which first and second fixed electrodes are arranged back to back and facing each other in a mutually non-conductive state, and first and second diaphragms are arranged facing the first and second fixed electrodes with fixed intervals from the first and second fixed electrodes, respectively;

a first impedance converter having an input terminal connected to the first fixed electrode, and a first buffer circuit connected to the first impedance converter;

a second impedance converter having an input terminal connected to the second fixed electrode, and a second buffer circuit selectively connected to the second impedance converter; and a directivity variable switch that is able to alternatively select a mode from at least a first directivity mode to a third directivity mode, wherein, when the directivity variable switch selects the first directivity mode, the second buffer circuit is connected to an output terminal of the second impedance converter, when the directivity variable switch selects the second directivity mode, an input terminal of the second buffer circuit is grounded, when the directivity variable switch selects the third directivity mode, the first diaphragm is connected to the output terminal of the second impedance converter, and the input terminal of the second buffer circuit is grounded, and the second diaphragm is grounded at all times, and balanced outputs of audio signals are derived from output terminals of the first and second buffer circuits.

2. The variable directivity electret condenser microphone according to claim 1, wherein the directivity variable switch is configured from a two-interlocking type three-point selector switch.

3. The variable directivity electret condenser microphone according to claim 1, wherein the balanced output audio signals respectively derived from the output terminals of the first and second buffer circuits are mixed by a mixer and output.

4. The variable directivity electret condenser microphone according to claim 1, wherein a phantom power source for the variable directivity electret condenser microphone is supplied from the output terminals of the first and second buffer circuits.

5. The variable directivity electret condenser microphone according to claim 1, wherein the first electret condenser microphone unit is a front-side unit at a sound collection axis and the second electret condenser microphone unit is a back-side unit at the sound collection axis.

6. The variable directivity electret condenser microphone according to claim 1, wherein, when the directivity variable switch selects the first directivity mode, the mode is set to bidirectivity, when the directivity variable switch selects the second directivity mode, the mode is set to unidirectivity, and when the directivity variable switch selects the third directivity mode, the mode is set to omnidirectivity.

7. The variable directivity electret condenser microphone according to claim 1, wherein a direct-current operation voltage is supplied to the first and second impedance converter from a common constant voltage circuit.

8. A variable directivity electret condenser microphone comprising:

electrically independent first and second electret condenser microphone units in which first and second fixed electrodes are arranged back to back and facing each other in a mutually non-conductive state, and first and second diaphragms are arranged facing the first and second fixed electrodes with fixed intervals from the first and second fixed electrodes, respectively;

a first impedance converter having an input terminal connected to the first diaphragm, and a first buffer circuit connected to the first impedance converter;

a second impedance converter having an input terminal connected to the second diaphragm, and a second buffer circuit selectively connected to the second impedance converter, and a directivity variable switch that is able to alternatively select a mode from at least a first directivity mode to a third directivity mode, wherein, when the directivity variable switch selects the first directivity mode, the second buffer circuit is connected to an output terminal of the second impedance converter, when the directivity variable switch selects the second directivity mode, an input terminal of the second buffer circuit is grounded, when the directivity variable switch selects the third directivity mode, the first fixed electrode is connected to the output terminal of the second impedance converter, and the input terminal of the second buffer circuit is grounded, and the second fixed electrode is grounded at all times, and balanced outputs of audio signals are derived from output terminals of the first and second buffer circuits.

9. The variable directivity electret condenser microphone according to claim 8, wherein the directivity variable switch is configured from a two-interlocking type three-point selector switch.

10. The variable directivity electret condenser microphone according to claim 8, wherein the balanced output audio signals respectively derived from the output terminals of the first and second buffer circuits are mixed by a mixer and output.

11. The variable directivity electret condenser microphone according to claim 8, wherein a phantom power source for the variable directivity electret condenser microphone is supplied from the output terminals of the first and second buffer circuits.

12. The variable directivity electret condenser microphone according to claim 8, wherein the first electret condenser microphone unit is a back-side unit at a sound collection axis and the second electret condenser microphone unit is a front-side unit at the sound collection axis.

13. The variable directivity electret condenser microphone according to claim 8, wherein, when the directivity variable switch selects the first directivity mode, the mode is set to bidirectivity, when the directivity variable switch selects the second directivity mode, the mode is set to unidirectivity, and when the directivity variable switch selects the third directivity mode, the mode is set to omnidirectivity.

14. The variable directivity electret condenser microphone according to claim 8, wherein a direct-current operation voltage is supplied to the first and second impedance converter from a common constant voltage circuit.

* * * * *